US006253477B1

(12) United States Patent
Balint

(10) Patent No.: US 6,253,477 B1
(45) Date of Patent: Jul. 3, 2001

(54) RETRO-REFLECTIVE SIGN

(75) Inventor: Gregory J. Balint, Windsor (CA)

(73) Assignee: Hallmark Technologies, Inc., Windsor (CA)

( * ) Notice: Subject to any disclaimer, the term of this patent is extended or adjusted under 35 U.S.C. 154(b) by 0 days.

(21) Appl. No.: 09/159,351

(22) Filed: Sep. 23, 1998

(51) Int. Cl.[7] ..... G09F 7/00
(52) U.S. Cl. ..... 40/612; 40/582; 40/615
(58) Field of Search ..... 40/555, 582, 612, 40/615

(56) References Cited

U.S. PATENT DOCUMENTS

| | | | | |
|---|---|---|---|---|
| 285,270 | * | 9/1883 | Jaeger | 40/582 X |
| 625,464 | | 5/1899 | Pfister . | |
| 1,377,161 | * | 5/1921 | Vanderbeek | 40/582 X |
| 1,562,835 | * | 11/1925 | Kuttler | 40/582 X |
| 1,580,921 | | 4/1926 | Scherer . | |
| 1,696,489 | | 12/1928 | Kahn . | |
| 1,807,145 | * | 5/1931 | Bart | 40/612 X |
| 1,846,173 | * | 2/1932 | Willwerscheid | 40/615 |
| 2,167,149 | | 7/1939 | Grote . | |
| 2,193,057 | | 3/1940 | Carver . | |
| 2,379,741 | | 7/1945 | Palmquist . | |
| 3,065,559 | | 11/1962 | McKenzie . | |
| 3,279,110 | * | 10/1966 | Lelicoff | 40/555 |
| 3,409,344 | | 11/1968 | Balint et al. . | |
| 3,494,912 | | 2/1970 | Toyama et al. . | |
| 3,772,810 | | 11/1973 | Kupperman et al. . | |
| 3,821,860 | * | 7/1974 | Patty | 40/555 |
| 3,877,786 | | 4/1975 | Booras et al. . | |
| 3,922,433 | | 11/1975 | Patterson et al. . | |
| 3,924,929 | * | 12/1975 | Holmen et al. | 40/612 X |
| 3,934,065 | | 1/1976 | Tung . | |
| 3,970,033 | | 7/1976 | Lindner et al. . | |
| 3,975,083 | * | 8/1976 | Rowland | 350/103 |
| 3,994,086 | | 11/1976 | Mizuochi . | |
| 4,025,674 | | 5/1977 | Mizuochi . | |
| 4,082,426 | | 4/1978 | Brown . | |
| 4,099,838 | | 7/1978 | Cook et al. . | |
| 4,202,600 | * | 5/1980 | Burke et al. | 350/103 |
| 4,240,220 | * | 12/1980 | Smith | 40/582 X |
| 4,243,618 | * | 1/1981 | Van Arnam | 264/1 |
| 4,489,669 | * | 12/1984 | Carman | 116/202 |
| 4,519,154 | | 5/1985 | Molari, Jr. . | |
| 4,544,586 | | 10/1985 | Molari, Jr. . | |
| 4,551,161 | | 11/1985 | Savolskis et al. . | |
| 4,555,161 | * | 11/1985 | Rowland | 40/615 X |
| 4,710,053 | * | 12/1987 | Kulp et al. | 404/9 |
| 4,726,134 | * | 2/1988 | Woltman | 40/582 |
| 4,995,185 | | 2/1991 | Cheng . | |

(List continued on next page.)

FOREIGN PATENT DOCUMENTS 719817 10/1965 (CA) .

*Primary Examiner*—Anthony Knight
*Assistant Examiner*—Andrea Chop
(74) *Attorney, Agent, or Firm*—Harness, Dickey & Pierce, P.L.C.

(57) ABSTRACT

A retro-reflective sign is formed of a lens plate bearing indicia and having a front face and a rear face. The rear face is formed with a plurality of adjacent cube corner configurations having central axes, which configurations may reflect light rays approximately parallel to incoming light rays. The front face can be formed with adjacent rows of prisms that are saw-tooth shaped in cross-section. The prisms overlap the configurations and are shaped to bend incoming light rays towards the axes of their respective overlapped configurations and to re-bend the reflected light rays parallel to the incoming light rays. The lens plate is bowed so that its front face is convex and its rear face is concave. A rearwardly bowed support plate covers the rear face of the lens plate and the two plates are secured together along their peripheral edges for rigidifying the sign. The rear plate may be sufficiently light transparent to pass some light therethrough to backlight the indicia on the front plate.

18 Claims, 3 Drawing Sheets

U.S. PATENT DOCUMENTS

| | | | | |
|---|---|---|---|---|
| 5,050,327 | | 9/1991 | Woltman . | |
| 5,442,870 | | 8/1995 | Kochanowski . | |
| 5,450,235 | * | 9/1995 | Smith et al. | 359/529 |
| 5,489,121 | * | 2/1996 | Mohr | 281/43 |
| 5,780,140 | * | 7/1998 | Nilsen | 40/612 X |
| 5,868,630 | * | 2/1999 | Saksun, Jr. | 473/150 |
| 5,905,826 | * | 5/1999 | Benson, Jr. et al. | 385/31 |
| 5,936,769 | * | 8/1999 | Nohara | 359/529 |
| 6,029,382 | * | 2/2000 | Kochanowski | 40/582 |

* cited by examiner

FIG - 1
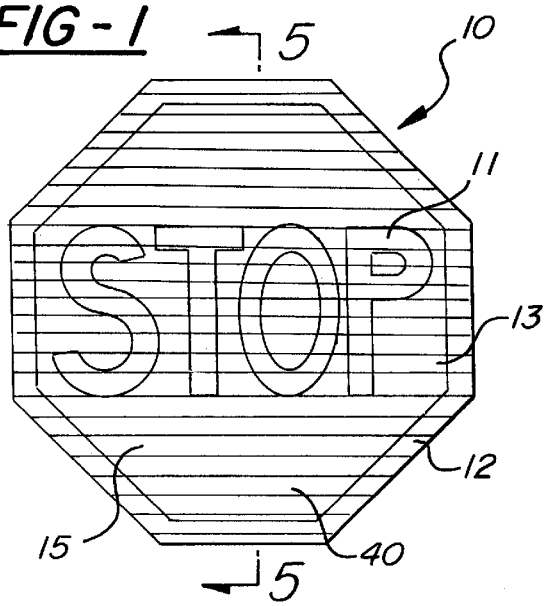
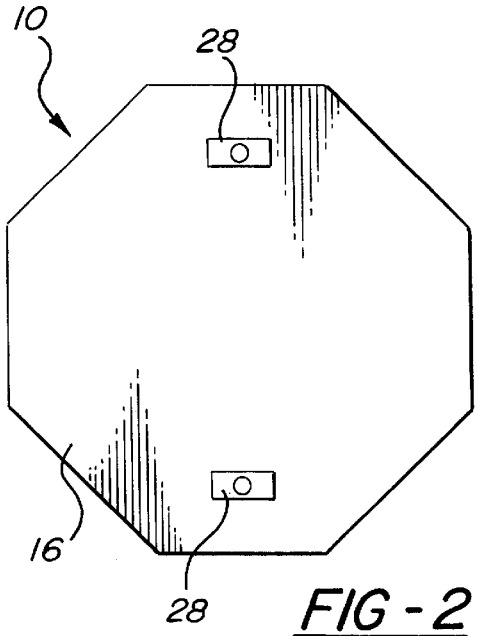
FIG - 2
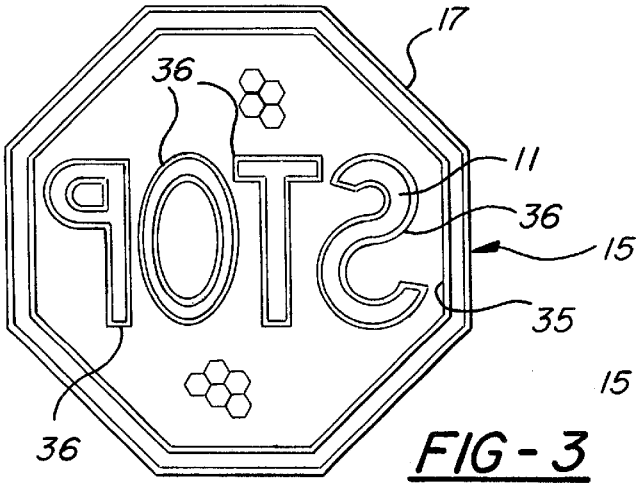
FIG - 3
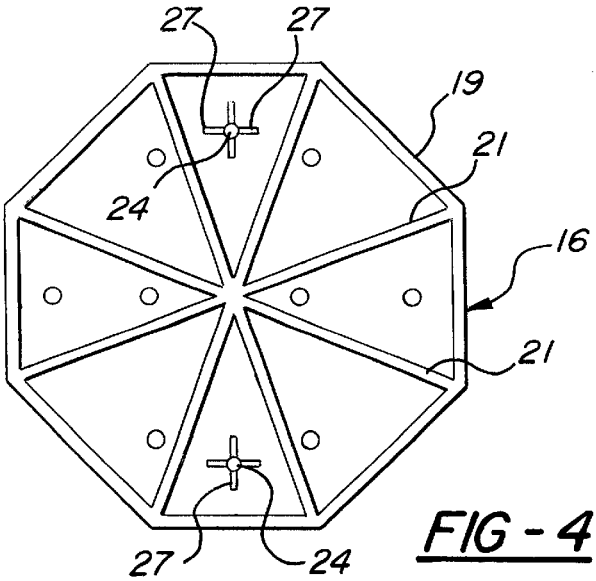
FIG - 4
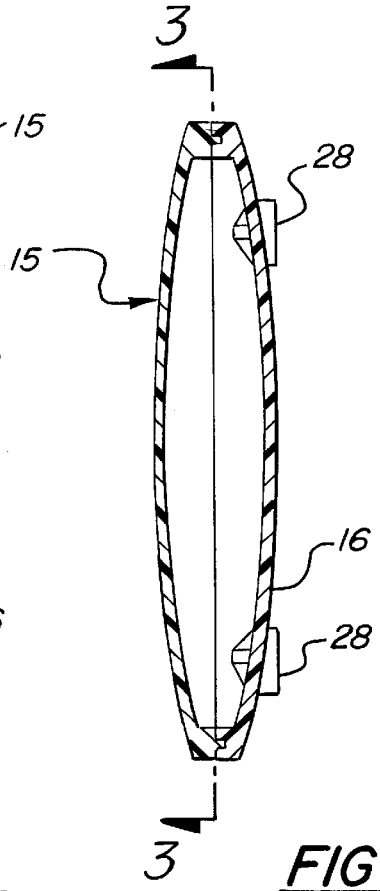
FIG - 5

RETRO-REFLECTIVE SIGN

BACKGROUND OF INVENTION

This invention relates to a retro-reflective sign particularly useful as a road sign which is made visible at night by reflecting automotive vehicle light beams.

Conventional highway signs, such as stop signs, one-way or wrong-way signs, informational type of signs such as indicating distances or highway exits and the like, are made of panels upon which the sign information or indicia is painted or otherwise imprinted. Such signs may also have standard recognized shapes which, themselves, indicate the type of message, such as a stop sign with an octagonal peripheral shape.

In order to make such signs more visible to vehicle drivers at night, it is conventional to make the signs reflective by utilizing special reflective paints or reflective coatings or beads. Thus, beams of light from the headlights of a vehicle are reflected from the sign panels, so that the messages or indicia are more readily visible to the vehicle driver as the vehicle approaches the sign. In order to make such sign messages visible at maximum distances, it is desirable to make the signs as reflective as possible. Thus, various techniques have been used to increase the reflectivity of the signs, so that their messages are brightly illuminated.

One known light reflective system involves the use of retro-reflective cube corner configurations impressed within the rear surface of a relatively transparent sign panel or lens panel. Incoming or incident light rays from an automotive vehicle light beam, which strike the exposed face of the panel, pass through the panel to the cube-corner retro-reflective configurations, located on the rear face of the panel, and are reflected back through the panel towards the source of the light. The light rays entering the cube corners are bounced from one surface to another and are reflected back approximately parallel to the corresponding incoming rays.

Examples of retro-reflective road signs are disclosed in U.S. Pat. No. 5,442,870 issued Aug. 22, 1995 to George E. Kochanowski for a "Reflective Sign." Other examples of the use of cube-corner, retro-reflective types of reflective signs or panels are disclosed in U.S. Pat. No. 2,167,149 to Walter F. Grote, issued Jul. 25, 1939 for a "Total Reflecting Prism Sheet"; U.S. Pat. No. 2,193,057 issued Mar. 12, 1940 to Horace N. Carver for a "Sign"; U.S. Pat. No. 3,772,810 issued Nov. 20, 1973 to Sam Kupperman, et al. for a "Reflecting Figure to be Applied to a Support Surface"; and U.S. Pat. No. 3,970,033 issued Jul. 20, 1976, to Henry Linder, et al. for a "Portable Reflector Device." Another use of such type of reflective device is illustrated in U.S. Pat. No. 3,409,344 issued Nov. 5, 1968 to Rudolf Douglas Balint for "Roadway Reflectors" used to mark the surfaces of pavements.

The prior retro-reflective signs, generally, reflect light by passage of the incoming or incident rays of light from an automotive vehicle headlight beam, through the front surface of a panel, then through the panel to the cube-corner reflective rear surface configurations. The light rays bounce between the three walls making up each cube corner and then are reflected back through the panel and out the front face in approximate parallelism to the incoming light rays. That is, corresponding incoming and outgoing light rays are roughly parallel.

It is desirable to direct the incoming rays as parallel as possible to the cube axes so that they reflect parallel to their respective cube axes. This provides for maximum intensity of reflection. There is a tendency for the reflected light rays to scatter or reflect at an angle relative to the driver of the vehicle which is the source of the incoming rays, rather than to be directed back toward the source of the light and the driver's view. This reduces the intensity of the reflection and correspondingly, the distance at which the reflected message on the sign may be clearly seen.

Thus, this present invention is concerned with improving the construction of the lens panel of a retro-reflective sign to better direct and intensify the reflected light. In general, this construction functions to initially bend and direct incoming light beams into approximate parallelism with the vertical axes of their respective cube-corner configurations and, then, to re-bend the reflected light coming from the cube corners towards the source of the light so as intensify the reflection and increase the distance at which the sign message is plainly visible.

In addition, this invention is concerned with improving the physical strength of a highway sign which is formed of molded plastic material and to make the sign message more visible to oncoming drivers by utilizing ambient light to backlight a sign message that may be molded or otherwise formed on the sign panel. That is, large sign panels which are formed of thin plastic sheet-like material are relatively weak. Since road signs are subject to intermittent relatively high forces, such as strong winds (which tend to damage the sign panels), this invention provides an integrally molded surface configuration on the sign panel and a separate support or backing panel which substantially rigidifies and strengthens the sign panel. Furthermore, the support panel may assist in utilizing ambient light to intensify the readability of the sign message.

SUMMARY OF INVENTION

This invention relates to a retro-reflective sign having a front lens or sign panel, which is molded out of a transparent plastic material, and a rear support or backing panel which may be translucent or opaque. The rear surface of the lens panel is formed with a pattern of depressed, adjacent cube-corner configurations which reflect light rays, and raised ribs or beads which form a honeycomb pattern surrounding groups of cube corner configurations. The front surface of the lens panel may be smooth or, alternatively, may be formed with integral wedge-like or sawtooth prism shapes. The prism shapes bend incoming light rays toward the cube axes which results in increasing the intensity of the reflected light. This maximizes visibility to the approaching vehicle driver; particularly in the case of overhead or raised type signs.

Further, this invention is concerned with providing a rigid, strong, sign construction by forwardly bowing the lens panel and attaching to the lens panel a rearwardly bowed support or backing panel. The two panels are joined together along their peripheral edges. In addition, ribs are integrally formed on the backing panel to increase the strength and rigidity of the combined panels.

The backing or support panel may be made of a translucent plastic material which will pass some ambient light to the rear, and through, the lens panel. For example, sunlight passing through the backing panel can backlight or further illuminate the sign message formed on the translucent lens panel.

An object of this invention is to provide a roadway sign, such as a stop sign or the like, which is formed of a pair of oppositely bowed, overlapped panels or plates that are connected together along their adjacent edges. One plate forms a front—message bearing—lens panel having molded cube-corner retro-reflective configurations formed on its rear face and, optionally, saw-tooth shaped prisms formed on its front face for intensifying and directing reflecting light rays striking the lens panel. The two joined plates provide a unitary wind-resistant, strong and rigid sign.

Another object of this invention is to provide a molded plastic highway sign having a forwardly bowed lens panel with a reflective rear face and a light ray bending or focusing front face for intensifying and directing reflected light rays towards an incoming light ray source, such as automotive vehicle headlights, and a rearwardly bowed backing panel joined to the lens panel. Preferably, the backing panel is made of a molded plastic material which is translucent or transparent so that it transmits some light to backlight indicia on the lens.

A further object of this invention is to provide a plastic molded sign having a transparent, forwardly bowed message bearing lens panel formed with a retro-reflective rear surface made of a pattern of grooves of impressed reflective corner cube configurations with raised ribs surrounding and separating the groups, and a rearwardly bowed backing panel overlapping the lens panel, with the two panels joined together along their peripheral edges to form a unitary sign construction. Optionally, the backing panel may be formed of a light passing plastic material which may permit ambient light to backlight the lens panel.

Yet another object of this invention is to form a reflective highway sign having a front, transparent, lens panel bearing message indicia formed of patterns of reflective cube-corner configurations impressed on the rear face of the lens panel and a rear support panel that overlaps and is spaced from, but is joined to the lens panel. A honeycomb pattern of ribs molded on the rear race of the lens panel and radially directed ribs molded on the forward face of the support panel rigidifies and strengthens the panels and the sign construction.

In general, the object of this invention is to provide a reflective sign which is more visible both at night and in the day than what conventional signs are, and which is extremely sturdy and wind resistant, and which has exposed surfaces that are easily cleaned, so as to improve the useable life of a highway sign.

These and other objects and advantages of this invention will become apparent upon reading the following description, of which the attached drawings form a part.

DESCRIPTION OF DRAWINGS

FIG. 1 is a front, elevational view of a stop sign.

FIG. 2 is a rear, elevational view of a stop sign.

FIG. 3 is a rear, elevational view of the front or lens plate of the sign taken in the direction of Arrows 3—3 of FIG. 5.

FIG. 4 is a front, elevational view of the backing or support plate.

FIG. 5 is an enlarged, cross-sectional, schematic view of the sign taken in the direction of Arrows 5—5 of FIG. 1, with the bowing of the plates being exaggerated for illustration purposes.

DETAILED DESCRIPTION

Figure 6:
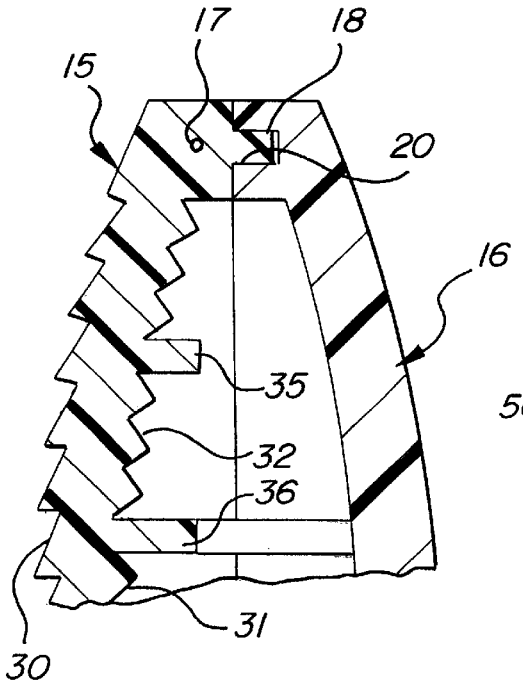
FIG. 6 is an enlarged, schematic, fragmentary view of an edge portion of the sign showing prism formations formed on the front face of the lens plate.

Referring to the drawings, FIG. 1 illustrates a front view of a stop sign 10 which is formed in a conventional octagonal shape. This sign has indicia 11, which spell the word "stop," and a border 12 adjacent the peripheral edge of the sign. The indicia and the border may be clear or white while the field or area 13 surrounding the indicia and contained within the border, may be colored red as is conventional on stop signs. The sign may be made in a number of colors and the indicia may be varied, depending upon the type or purpose of the sign. Similarly, the shape of the sign may be round or square or rectangular, depending upon the type of sign and the message to be given by the sign.

The sign is formed of a front, or forward, lens panel or plate 15 and a rear backing or support plate or panel 16. The two plates are formed of molded plastic, such as of a conventional polycarbonate plastic material used for molded signs. The two plates overlap and are secured together along their peripheral edges.

A preferred form of securement of the plates comprises an edge rim or bead 17 formed on the lens plate (see FIG. 6). The rim has a tongue 18 which may be continuous. The backing plate is provided with an edge rim 19 having a groove 20 which receives the tongue 18. The tongue and groove connection may be held together by a suitable adhesive or by a frictional, interference type of fit of the tongue within the groove or by ultrasonic welding.

The plates 15 and 16 are preferably bowed in opposite directions. Thus, preferably each plate is a segment of a sphere of a large radius. The bowing of the plates is exaggerated in the schematic illustrated in FIG. 5. The amount of bowing would be determined by the sign designer, and would take into consideration the thickness of each of the plates, the size of the signs, and the intended strength of the sign. For example, a stop sign may be about 30 inches in diametrical direction with the bowing radii of the two plates being approximately 40 feet, and the plates having a wall thickness of about 0.16 inches. The curvature and the thickness of each of the plates may vary, depending upon size and strength requirements.

The bowing of the plates, even though a relatively small amount of curvature, strengthens the sign and enables the sign to withstand substantial wind gusts or wind forces applied against the sign as well as reducing the glare from any light source.

Preferably, the backing plate or support plate 16 is provided with raised beads or ribs 21 which may be radially arranged to extend from approximately the middle of the plate towards the peripheral edges of the plate. These raised ribs stiffen and reinforce the backing plate. The support plate 16 has a front portion 50 and a rear portion 52.

In addition, spaced apart projections or spacers 22 may be molded or otherwise joined to the forward face of the backing plate to engage the rear of the lens plate. The lengths of the projections vary to bridge the length of the space between the plates at the locations of the respective projections. To attach the sign to a support post 23 (schematically shown in FIG. 9 and 11) threaded socket members 24 are formed on the forward surface of the backing plate to receive fastening screws or the like 25 in threaded openings 26. Fins 27 connect the socket members to the backing plate for reinforcement purposes. In addition, integral pads 28 molded on the rear face of the backing plate form seats for the support post. The size and thickness of the pads 28 will vary, depending upon the type of mounting posts or other support devices that may be used for the sign.

The lens plate 15 has a front, exposed face 30 and a rear face 31. The rear face 31 is molded with a pattern of adjacent, depressed, cube corners which form a retro-reflective configurations 32 (see FIG. 6). Such configurations are conventional. Cube corner reflective surfaces function to reflect rays of light passing through a lens plate to the reflective rear surface of the plate, which is provided with the depressed retro-reflective cube corners. The sizes and the locations or patterns of the cube corners may be varied, depending upon the size and shape of the sign and its indicia.

Figure 11:
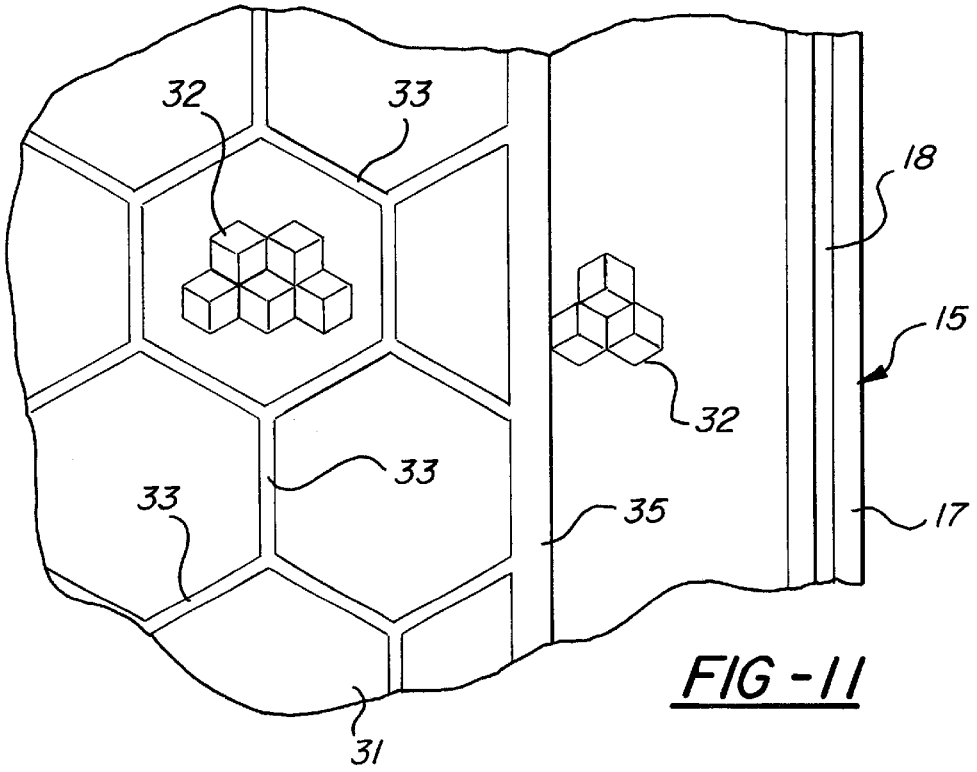
FIG. 11 is an enlarged, elevational view of a fragment of the rear surface of the lens plate illustrating the honeycomb reinforcing rib pattern.
Figure 12:
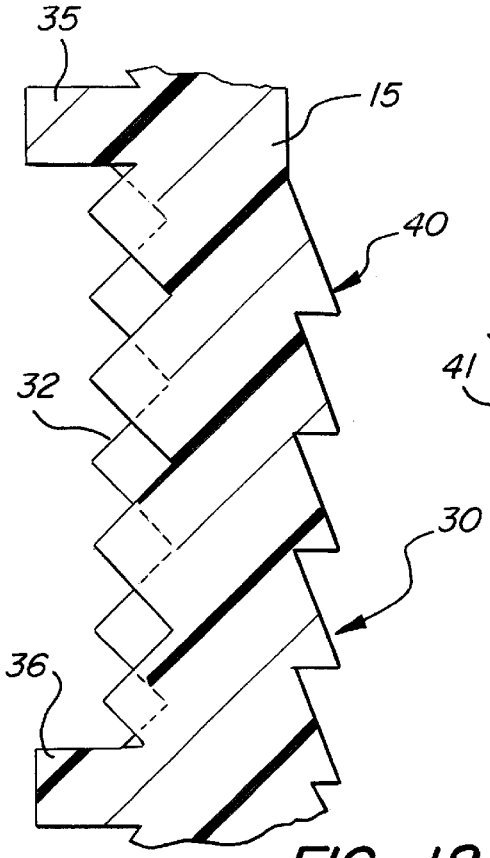
FIG. 12 is an enlarged, schematic view of a cross-sectional fragment of the lens plate showing the front and rear surfaces of the plate, with prisms formed on the front surfaces.

The rear face 31 of the lens plate is also provided with raised ribs 33 which form a honeycomb type pattern, imposed around the pattern of cube corners. The ribs may be formed in pattern in the shapes of hexagons or other geometric shapes which surround, and are surrounded by, the cube corner configurations. In addition, an edge bead or rib 35 is formed adjacent the peripheral edge of the lens plate, as is schematically shown in FIGS. 3 and 11. Similarly, edge beads or ribs 36 are molded integrally with the rear face of the lens plate around each of the letters forming the indicia or message (see FIG. 3).

In one modification, the front face 30 of the lens plate 15 is formed with a plurality of wedge-shaped, saw-tooth in cross-section shape, prisms 40. These prisms may be in the form of rows or strips extending across the front face of the lens plate. These prisms cooperate with the cube corner configuration, as will be described below, in reflecting incoming light rays.

Figure 13:
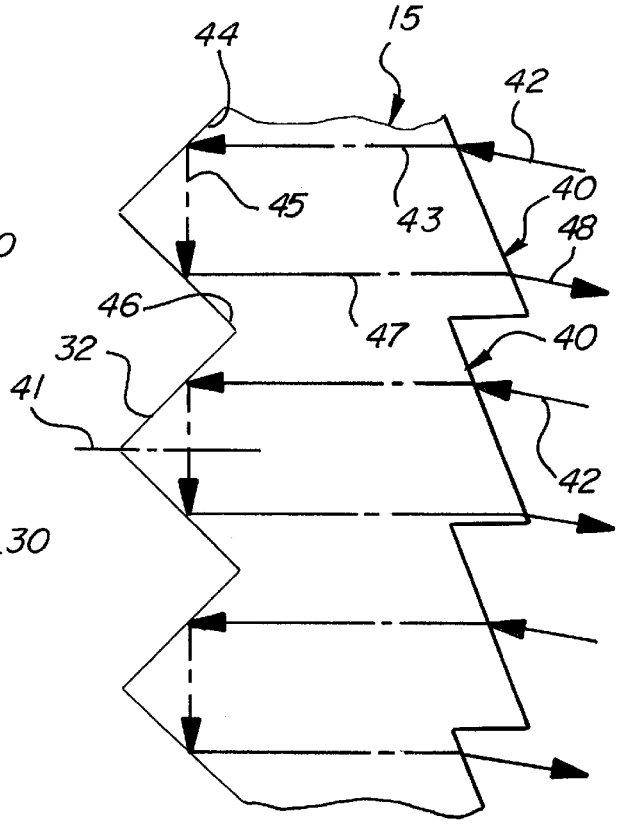
FIG. 13 is a further enlarged view of a fragment of the lens plate, shown in cross-section, and schematically illustrating the movement of light rays into and out of the lens plate.

The reflection of light rays is schematically shown in FIG. 13. Each of the cube corners has a central axis 41. An incoming light ray 42, which may come from an automobile headlight beam, strikes one of the prisms 40 on the exposed or forward surface of the lens. The prism bends the incoming light beam into a light ray portion 43 which travels transversely through the plate, substantially parallel to the cube corner axis 41, to contact a cube corner wall 44. The ray portion 45 is reflected to the opposite cube corner wall 46 from which the ray portion 47 is reflected back, approximately parallel to the cube corner axis 41, through the lens panel to the prism 40. The prism 40 re-bends the reflected light ray to form a reflected ray 48 directed towards the source of the light, that is, towards the automotive vehicle light beam and approximately parallel to the incoming ray portion 42.

The intensity of the visible reflection is substantially increased because the incoming and returning light ray portions 42 and 48 are approximately parallel to the central axes 41 of the corner cubes which they strike (see FIG. 13).

In essence, the corner cube retro-reflective configuration receives a light ray, which passes through the lens, and then, the ray is bounced within the cube structure and reflected outwardly, roughly parallel to the incoming ray. However, where the ray enters a corner cube at an angle relative to the axis of the cube, it similarly leaves at approximately the same angle and, consequently, is dispersed or reflected at an angle relative to the headlight beam of the vehicle.

If the reflected light beam is directed towards the vehicle which is the source of the headlight beam, as seen by the driver, the visibility or intensity of the reflected light is substantially greater than where the light ray is reflected at an angle to the source. In this case, the term "intensity" is meant to refer to the visibility or visual brightness of the reflected light to the vehicle driver who is located at a distance rearwardly of the headlight beam light source. Hence, returning the light in the direction of the headlight beam, intensifies or brightens the reflection seen by the vehicle driver so that the driver may see the reflected light at a greater distance than otherwise and the driver may see it more sharply than otherwise.

Figure 7:
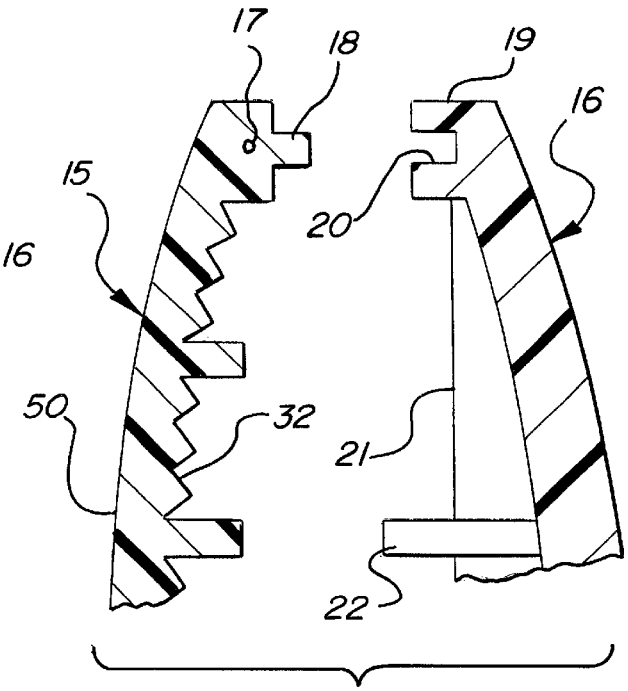
FIG. 7 is an enlarged, schematic, fragmentary view of the lens and backing plates separated, with the front face of the lens plate formed smooth rather than with prisms.
Figure 8:
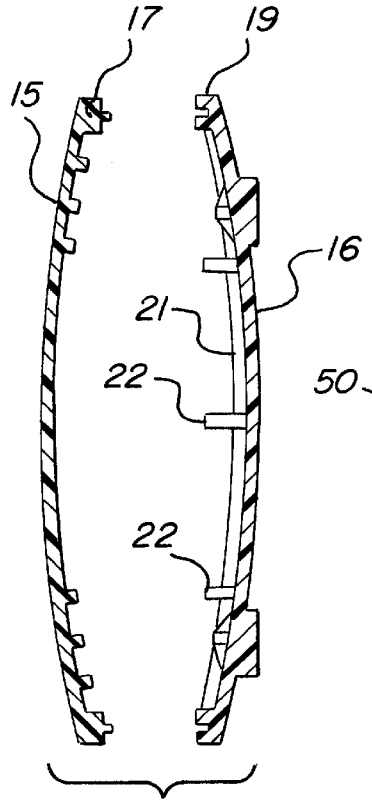
FIG. 8 is a cross-sectional, schematic elevational view showing the front lens plate, separated from the rear backing plate.
Figure 9:
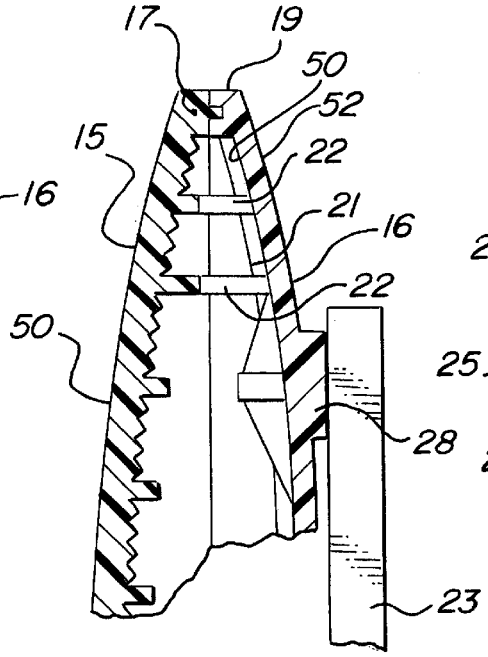
FIG. 9 is an enlarged, cross-sectional, schematic, fragmentary view of the front and the rear plates, joined together.
Figure 10:
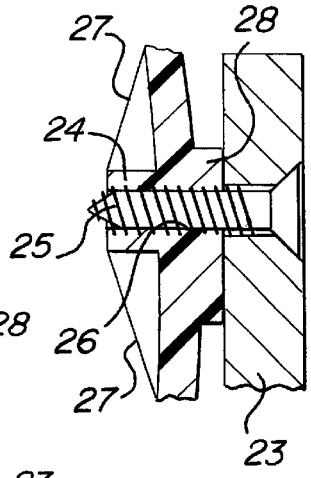
FIG. 10 is an enlarged, schematic cross-sectional view of the fastening section of the sign for fastening the sign upon a support post.

In a second modification of the lens plate front face, as shown in FIGS. 7 and 9, the surface 50 is smooth rather than formed with the prisms illustrated in FIG. 6.

In this type of sign structure, the indicia or wordings on the sign, as compared with the areas surrounding the indicia, may be molded of a different color plastic, using known plastic molding techniques. For example, the indicia may be clear or white, by using clear transparent plastic or white colored plastic and the surrounding field may be red by using red colored plastic to produce a stop sign. Alternatively, green or blue colored plastics may be used to produce an informational type of sign.

Further, despite the sign being formed of thin panels made of a molded plastic material, the sign is considerably strengthened by the pattern of ribs or beads formed in and around the reflective cube corner configuration and the letters forming the indicia on the lens plate. The strength of the composite, two plate, sign and its resistance to wind loads and other forces is further increased by the bowing of the two plates or panels and the rib structure on the backing plate. The rows of prisms preferably are curved to follow the curvature of the lens plate for bending incoming light rays into approximate parallelism with the respective overlapped cube corners and for re-bending reflected rays from such cube corners.

The molded plastic sign construction may be easily cleaned or maintained and its exposed surfaces will tend to shed dirt and moisture so as to be self-cleaning when subjected to rain. Hence, the foregoing sign construction will provide a strong, windresistant, easily cleaned, construction.

This invention may be further developed within the scope of the following claims. Accordingly, it is desired that the foregoing description be read as merely illustrative of an operative embodiment of this invention and not in a strictly limiting sense.

What is claimed is:

1. A retro-reflective sign comprising a lens plate with sign indicia molded within the lens plate, and having a front face and a rear face, said rear face being molded with a plurality of adjacent, retro-reflective cube corner configurations, defined by three intersecting walls of a cube which have a central axis, which configurations reflect incoming light rays that enter the plate through its front face and pass through the plate to its rear face and whose configurations reflect the light rays back through the plate and its front face generally towards the incoming light rays, said rear face of the lens plate further being molded with a protrusion extending opposite from the front face, the protrusion extending about the periphery of the lens plate;

a plurality of substantially continuous, raised ribs formed integral with the rear face of the lens plate and arranged in honeycomb patterns which surround groups of cube corner configurations so that numerous configurations are located within and outside of each honeycomb pattern; and a rear support plate connectable to the lens plate, the support plate having a plurality of radially extending stiffening ribs extending continuously from a middle of the support plate to outer peripheral edges of the support plate so as to reinforce the support plate, the outer peripheral edges of the support plate having a groove that is operable to receive said protrusion and for securing the lens plate and the support plate together.

2. A retroreflective sign as defined in claim 1, and said honeycomb pattern extends rearwardly from the rear face of the lens plate.

3. A retro-reflective sign as defined claim 1, whereas the support plate is overlapping and is spaced rearwardly of the rear face of the lens plate;

said lens plate and support plate being secured together along their peripheral edges.

4. A retro-reflective sign as defined in claim 3, and with a rearwardly extending rim formed on the peripheral edge of the lens plate, and a forwardly extending rim formed on the peripheral edge of the support plate;

and with the rims being fastened together to secure the plates together.

5. A retro-reflective sign as defined in claim 4, and with the support plate being bowed rearwardly relative to the lens plate.

6. A retroreflective sign as defined in claim 3, and said lens plate being bowed so that its front face is convex and its rear face is concave and said support plate being oppositely bowed relative to the lens plate.

7. A retro-reflective sign as defined in claim 6, and with said support plate being formed of a translucent material which passes at least some light Aherethrough so as to backlight the lens plate and indicia formed on the lens plate.

8. A retro-reflective sign as defined in claim 1, and at least a portion of said retro-reflective cube corner configurations being arranged in patterns which form message indicia so that the indicia are made visible by light rays received from a light source and passing from the front face to the rear face of the lens plate and then reflected back towards the light source by the configurations.

9. A retro-reflective sign as defined in claim 1, wherein the support plate is positioned rearwardly of the rear face of the lens plate and is secured to the lens plate along peripheral edges of the lens plate and the support plate;

the support plate having a front face which is spaced rearwardly of the rear face of the lens plate;

the ribs are integrally formed on the front face of the support plate to rigidify the support plate.

10. A retro-reflective sign as defined in claim 9, and the plates being oppositely bowed forwardly and rearwardly relative to each other, and spacers formed on one of said plates for engaging the other of said plates to maintain a bowed shape of the space between the two plates.

11. A retro-reflective sign molded from a single plastic resin comprising a light reflecting lens plate having a front face and a rear face being cube cornered and a plurality of groups of adjacent, cube corner retro-reflective configurations molded on said rear face for providing light-reflective areas, with the front face of the lens plate being colored in certain areas to spell out words on the sign and with the areas surrounding the words being made of material that is not of the same color, the lens plate further having an edge rim with an outwardly extending protrusion about the periphery of the lens plate;

prisms integrally molded on the front face of the lens plate and shaped to bend incoming light rays towards central axes of the respective cube corners which the respective prisms overlap; and a support plate spaced apart from the lens plate, the support plate having at least one rib integrally molded and extending continuously from a middle of the support plate to an outer edge of the support plate, the outer edge of the support plate having a groove that mates with the protrusion extending from the periphery of the lens plate.

12. A retro-reflective sign as defined in claim 11, and said prisms being formed in adjacent, parallel, strip-like rows extending along said front face and being generally saw-tooth-like in cross-sectional shape.

13. A retro-reflective sign as defined in claim 12, and said lens plate being bowed so that its front face is convex and its rear face is concave.

14. A retro-reflective sign as defined in claim 11, wherein the support plate is arranged to overlap the rear face of the lens plate and with the two plates secured together, the support plate having front and rear portions;

the rear face of the lens plate and the front portion of the support plate being spaced apart;

and said support plate being bowed so that the front portion is concave and the rear portion is convex.

15. A retro-reflective sign as defined in claim 14, and said support plate being formed of a light passing material through which at least some light may pass so as to backlight indicia formed on the lens plate.

16. A retro-reflective sign as defined in claim 11, and including integral raised ribs formed on the rear face of the lens plate and surrounding groups of cube corner configurations for rigidifying the lens plate.

17. A retro-reflective sign as defined in claim 16, and with at least one of the plates having an integral, substantially continuous edge flange forming a peripheral rim, with said rim being secured to the other plate for securing the plates together.

18. A retro-reflective sign comprising:

a lens plate with sign indicia molded within the lens plate, the lens plate having a front face and a rear face, the rear face being molded with a plurality of adjacent, retro-reflective cube corner configurations, defined by three intersecting walls of a cube which have a central axis, a plurality of substantially continuous, raised ribs formed integral with the rear face of the lens plate and arranged in honeycomb patterns which surround groups of cube corner configurations, the lens plate further having a tongue extending about its entire perimeter; and a back plate connectable to the lens plate, the back plate having a continuous edge rim located about its outer periphery with a u-shaped groove that is operable to receive the tongue of the lens plate in order to secure the lens and back plate together, a plurality of radially extending stiffening ribs extending continuously from a center of the back plate to the edge rim for reinforcing the back plate.

* * * * *